US007011030B1

(12) United States Patent
Jans

(10) Patent No.: US 7,011,030 B1
(45) Date of Patent: Mar. 14, 2006

(54) ATTACHMENT METHOD AND ARRANGEMENT FOR SOFTGOOD LOGO PATCH

(76) Inventor: Earl Jans, 2688 Rocky Trail, Diamond Bar, CA (US) 91765

( * ) Notice: Subject to any disclaimer, the term of this patent is extended or adjusted under 35 U.S.C. 154(b) by 0 days.

(21) Appl. No.: 11/073,080

(22) Filed: Mar. 4, 2005

(51) Int. Cl.
*D05B 35/06* (2006.01)

(52) U.S. Cl. ..... 112/104; 112/475.09

(58) Field of Classification Search ..... 112/475.09, 112/475.18, 475.23, 439, 154, 475.17, 400, 112/440, 104, 470.33; 36/136; 2/209.12, 2/213.7, 244, 246; 40/636, 329; 428/99; 156/93
See application file for complete search history.

(56) References Cited

U.S. PATENT DOCUMENTS 4,697,362 A * 10/1987 Wasserman ..... 36/136
4,712,314 A * 12/1987 Sigoloff ..... 36/112
4,776,043 A * 10/1988 Coleman ..... 2/209.12
4,837,960 A * 6/1989 Skaja ..... 40/636
5,800,900 A * 9/1998 Mitchell ..... 428/100
5,878,681 A * 3/1999 Asami ..... 112/475.18
5,974,997 A * 11/1999 Amburgey ..... 112/475.01
6,443,081 B1 * 9/2002 Quint ..... 112/475.18

* cited by examiner

*Primary Examiner*—Ismael Izaguirre
(74) *Attorney, Agent, or Firm*—Raymond Y. Chan; David & Raymond

(57) ABSTRACT

A logo patch arrangement for a piece of garment includes a background patch made of non-fabric materials, an affixing element, and a logo patch. The logo patch is overlapped on the affixing element to cover the affixing element, wherein the affixing element is hidden by the logo patch for enhancing an aesthetic appeal thereof while the logo patch is securely affixed on the garment via the background patch. The present invention also discloses a method of the logo patch arrangement.

17 Claims, 6 Drawing Sheets

ATTACHMENT METHOD AND ARRANGEMENT FOR SOFTGOOD LOGO PATCH

BACKGROUND OF THE PRESENT INVENTION

1. Field of Invention

The present invention relates to a logo patch, and more particularly to a method and arrangement for attaching a softgood logo patch to a garment, wherein an affixing element is kept under the curtain of a logo patch without exposing to an exterior thereof so as to enhance an aesthetic appeal of the logo patch while securely attaching on the garment.

2. Description of Related Arts

A conventional cloth, such as a conventional jersey, usually comprises an integral piece of garment, and a plurality of logo patches sewed on the garment for enhancing an aesthetic appeal of the cloth.

A major feature for this type of conventional jersey is that the logo patches are usually sewed on the garment along a side edge of the relevant logo patch by some sorts of affixing elements, such as fabric strings, which penetrate the logo patch and the garment so as to securely connect them together. Consequently, a major drawback for this type of cloth is that the affixing element is exposed to an exterior of the logo patch so that people looking at the cloth, such as the jersey with fascinating football club's logo, would easily discover that the affixing elements is 'surrounding' the logo patch so as to adversely affect the aesthetic appeal of the entire cloth.

In order to resolve this problem, there exist some clothes in which the logo patches are affixed on the garment by some sorts of glue or other adhesive materials so that no affixing element, such as the above-mentioned fabric string, is required for connecting the logo patch with the garment. A problem for this kind of clothes is that the performance of the adhesive materials is usually unsatisfactory, rendering the attachment between the logo patches and the garment insecure. Thus, it is not surprising to see that people may wear a jersey in which the logo patches have been detached from the garment.

SUMMARY OF THE PRESENT INVENTION

A main object of the present invention is to provide logo patch arrangement wherein an affixing element is kept under the curtain of a logo patch without exposing to an exterior thereof so as to enhance an aesthetic appeal thereof while securely attaching the logo patch on the garment.

Another object of the present invention is to provide a logo patch arrangement wherein a background patch thereof is capable of guiding a secure attachment between the background patch and the garment, wherein the logo patch is attached on the background patch to embed the affixing element under the curtain thereof to enhance the aesthetic appeal of the logo patch.

Another object of the present invention is to provide a logo patch arrangement which is easy to manufacture and is capable of being utilized on a wide variety of garments so as to facilitate widespread application of the present invention.

Accordingly, in order to accomplish the above objects, the present invention provides a logo patch arrangement for a piece of garment, comprising:

a background patch made of non-fabric material;

an affixing element substantially affixing the background patch on the garment; and a logo patch overlapped on the affixing element to cover the affixing element, wherein the affixing element is hidden by the logo patch for enhancing an aesthetic appearance thereof while the logo patch is securely affixed on the garment via the background patch.

These and other objectives, features, and advantages of the present invention will become apparent from the following detailed description, the accompanying drawings, and the appended claims.

DETAILED DESCRIPTION OF THE PREFERRED EMBODIMENT

Figure 1:
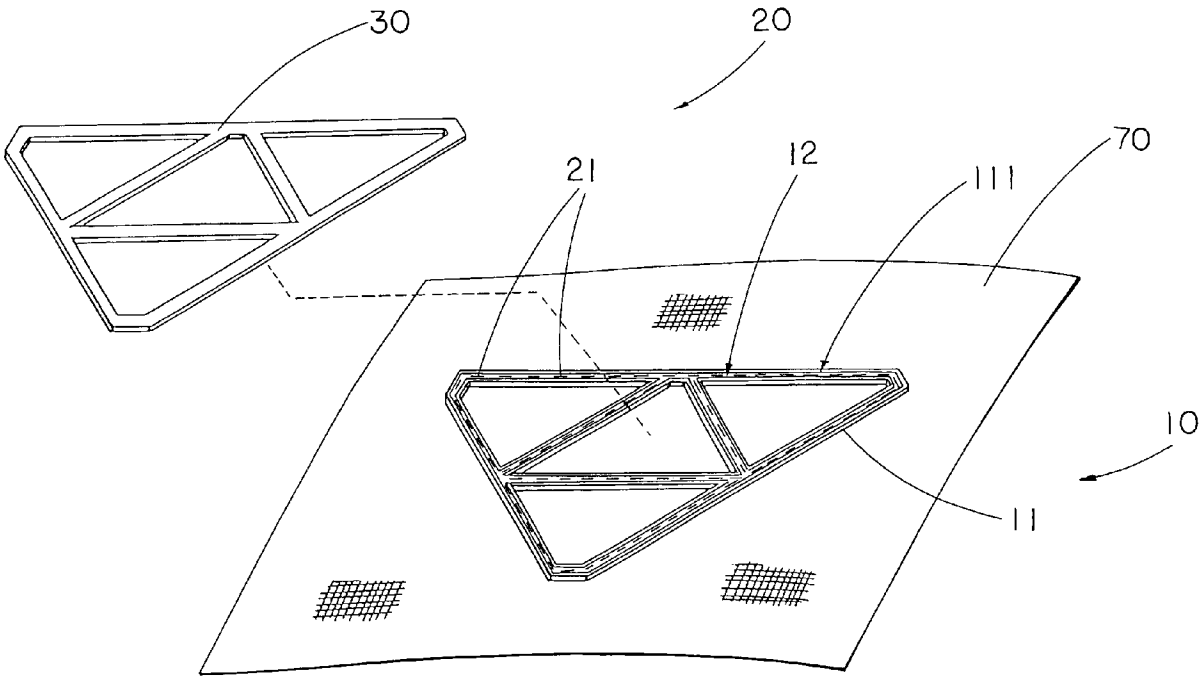
FIG. 1 is an exploded perspective view of a logo patch arrangement according to a first preferred embodiment of the present invention.
Figure 2:
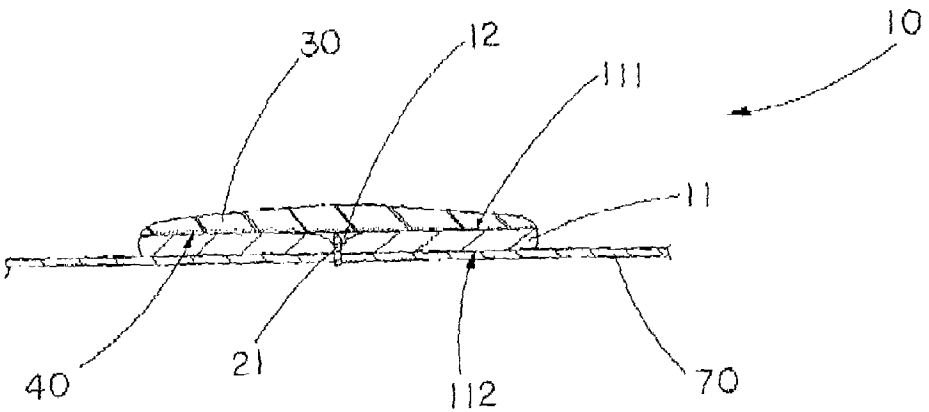
FIG. 2 is a sectional side view of the logo patch arrangement according to the above first preferred embodiment of the present invention.

Referring to FIGS. 1 to 2 of the drawings, a logo patch arrangement for a piece of garment 70 according to a preferred embodiment of the present invention is illustrated, in which the logo patch arrangement comprises a background patch 10, an affixing element 20, and a logo patch 30.

The background patch 10 is made of made of non-fabric materials having a predetermined materials strength which is capable of supporting the logo patch 30 and the affixing element 30.

The affixing element 20, which substantially affixes the background patch 10 on the garment 70, is preferably embodied as a fabric string which is capable of penetrating, by conventional sewing technique, the garment 70 and the background patch 10 for sewing the background patch 10 on to the garment 70 in a secure manner. In other words, the affixing element 20 comprises a plurality of stitching lines 21 spacedly forming on the background patch 10 for securely affixing the background patch 10 on the garment 70.

The logo patch 30 is overlapped on the background patch 30 to cover the affixing element 20, wherein the affixing element 20 is hidden by the logo patch 30 for enhancing an aesthetic appeal thereof while the logo patch 30 is securely affixed on the garment 70 via the background patch 10.

The logo patch arrangement of the present invention is adapted for use in a garment for fashion purpose. Therefore, the piece of garment may be embodied in, but not limited to, jerseys, shoes, jackets, shirts, belts, and the likes.

Accordingly, the present invention further provides a method of attaching a softgood logo patch on a piece of garment 70, which comprises the following steps.

(1) Securely attach the background patch 10 on the piece of garment 70 by the affixing element 20, wherein the affixing element 20 embodies as a plurality of stitching lines 21 that the background logo 10 is sewn on the garment 70.

(2) Overlap the logo patch 30 on the background patch 10 so as to cover the affixing element 20 to enhance an aesthetic appeal of the logo patch 30 while the logo patch 30 is securely affixed on the garment 70 via the background patch 10, wherein the logo patch 30 is adhered on the background patch 10 to integrally attach the logo patch 30 on the background patch 10.

Referring to FIG. 1 and FIG. 2 of the drawings, the background patch 10 has a patch body 11 shaped and sized to form a predetermined pattern corresponding to the logo patch 30 which is to be shown on the garment 70, and a guiding groove 12 indently formed on a top surface 111 of the patch body 11, wherein the affixing element 20 is adapted to repeatedly and reciprocally penetrate the garment 70 and a bottom surface 112 of the patch body 11 so as to form a plurality of stitches received within the guiding groove 12 for overlappedly and securely sewing the garment 70 with the background patch 10.

According to the preferred embodiment of the present invention, the guiding groove 12 is elongatedly formed substantially along a center line of the top surface 111 of the background patch 10 which is corresponding to a shape thereof so as to ensure secure sewing between the background patch 10 and the garment 70.

As shown in FIG. 2, an exposing portion of the affixing element 20, which is the portion being seen on the top surface 111 of the background patch 10, is received in the guiding groove 12 such that when the logo patch 30 is overlapped on the background patch 10, the guiding groove 12 is enclosed by the logo patch 30 and the exposing portion of the affixing element 20 is hidden under the logo patch 30. It is worth to mention that the guiding groove 12 also guides the stitching lines 21 of the affixing element 20 to sew on the background patch 10 for securely affixing the patch body 11 on the garment 70.

The logo patch arrangement further comprises an adhering agent 40 applied on the background patch 10 to adhere the logo patch 30 on the background patch 10 so as to integrally attach the logo patch 30 on the background patch 10. In other words, the adhering agent 40 is provided between the background patch 10 and the logo patch 30 so as to overlappedly attach the logo patch 30 with the background patch 10 for keeping the affixing element 20 under the curtain of the logo patch 30 (i.e. hiding under the logo patch 30). Consequently, the affixing element 20 is invisible from an exterior of the logo patch 30.

In particular, the adhering agent 40 is preferably embodied as a conventional layer of adhesive materials for overlappedly binding the logo patch 30 with the background patch 10. The adhesive materials is preferably embodied as conventional glue or similar adhesive materials for securely attaching the logo patch 30 with the background patch 10 at the top surface 111 of the patch body 11.

Thus, it is worth mentioning that the logo patch 30 is preferably made of rubber, PVC or thermoplasrubber (TPR) so that they are adapted for being bound with the background patch 10 by the adhering agent 40 so as to attach on the garment 70 with optimal aesthetic appeal. However, the logo patch 30 can be made of metal which is different from the material of the background patch 10. Therefore, by applying a proper adhering agent 40, the logo patch 30 can be securely attached on the background patch 10 while the background patch 10 is substantially affixed on the garment 70.

Figure 3:
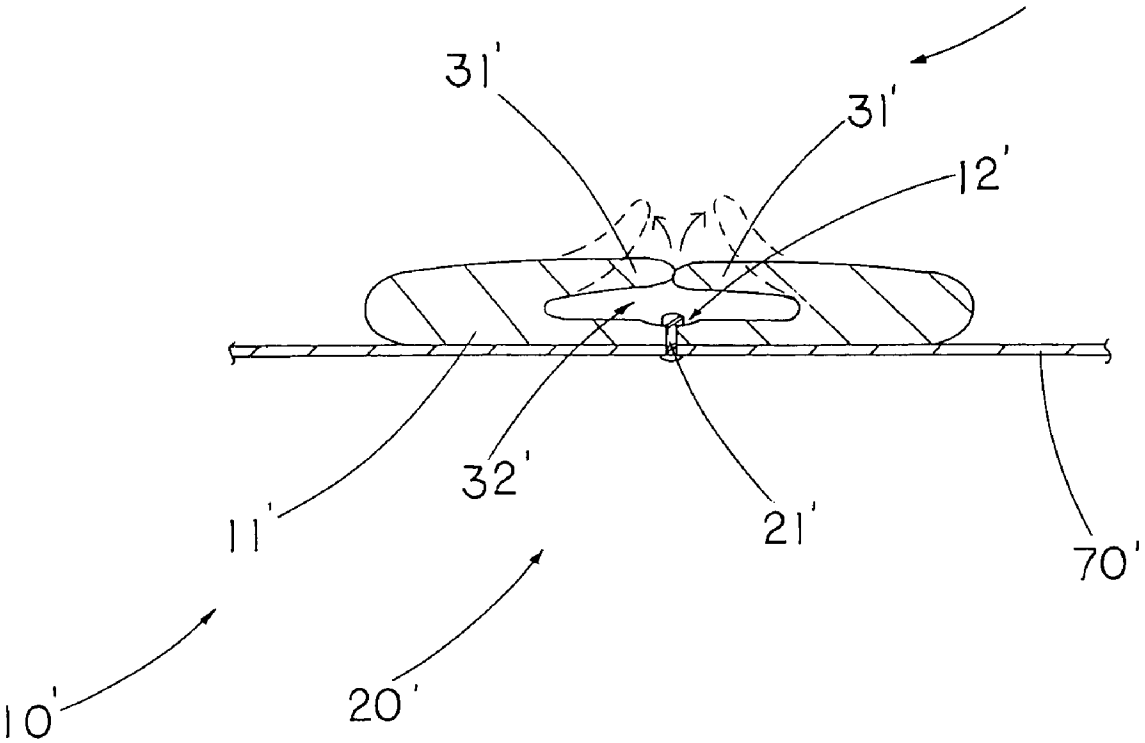
FIG. 3 is a first alternative mode of the logo patch arrangement according to the above first preferred embodiment of the present invention.

Referring to FIG. 3 of the drawings, a first alternative mode of the logo patch arrangement according to the above-mentioned preferred embodiment of the present invention is illustrated. The first alternative mode is similar to the above-mentioned preferred embodiment except that the logo patch 30' is integrally attached from the background patch 10'.

The logo patch 30' comprises two elastic enclosing members 31' integrally and spacedly extended on the background patch 10' to form an elongated centerline channel 32' within the two enclosing members 31' and the background patch 10' to receive an exposing portion of the affixing element 20' in the centerline channel 32', wherein the enclosing members 31' are normally extended to meet each other to enclose the centerline channel 32' so as to hidden the affixing element 20' therewithin.

In other words, the two enclosing members 31' are extended on top of the background patch 10' to move between a normal enclosing position and an open position. In the enclosing position, the enclosing members 31' are movably extended on top of the background patch 10' to substantially enclose the centerline channel 32' so as to hide the affixing element 20' under the curtain of the enclosing members 31'. In the opened position, the enclosing members 31' are outwardly stretched to expose the centerline channel 32' to an exterior of the logo patch arrangement so as to allow user to access the centerline channel 32' for sewing the background patch 10' with the garment 70'. According to the first alternative mode, the enclosing members 31' are elastic in nature in such a manner that they are normally retained at the enclosing position.

It is worth mentioning that the aesthetic pattern is then formed on the logo patch 30' including the enclosing members 31' so that the logo patch arrangement is capable of displaying the aesthetic pattern of the logo patch 30' without exposing the affixing element 20'. Therefore, by stretching the enclosing members 31' to the opened position, the manufacturer of the cloth is able to easily sew the background patch 10' to the garment 70' by the affixing element 20' and once that is finished, the enclosing members 31' would automatically return to the enclosing position so as to display the aesthetic pattern of the logo patch 30' without exposing the affixing element 20'.

Accordingly, the background patch 10' further has a guiding groove 12' indently formed on the patch body 11' to receive an exposing portion of the affixing element 20' in the guiding groove 12' and to guide the affixing element 20' for affixing the patch body 11' on the garment 70'. As shown in FIG. 3, the guiding groove 12' is formed along the patch body 11' and is aligned with the centerline channel 32'.

Moreover, as shown in FIG. 3 of the drawings, according to the first alternative mode, the affixing element 20' is preferably embodied as a plastic-made rivet 21' which is utilized to join the background patch 10' with the garment 70'. Likewise, the affixing element 20' can be the stitching lines 21 as shown in FIG. 1 to affix the background patch 10' on the garment 70'.

Figure 4:
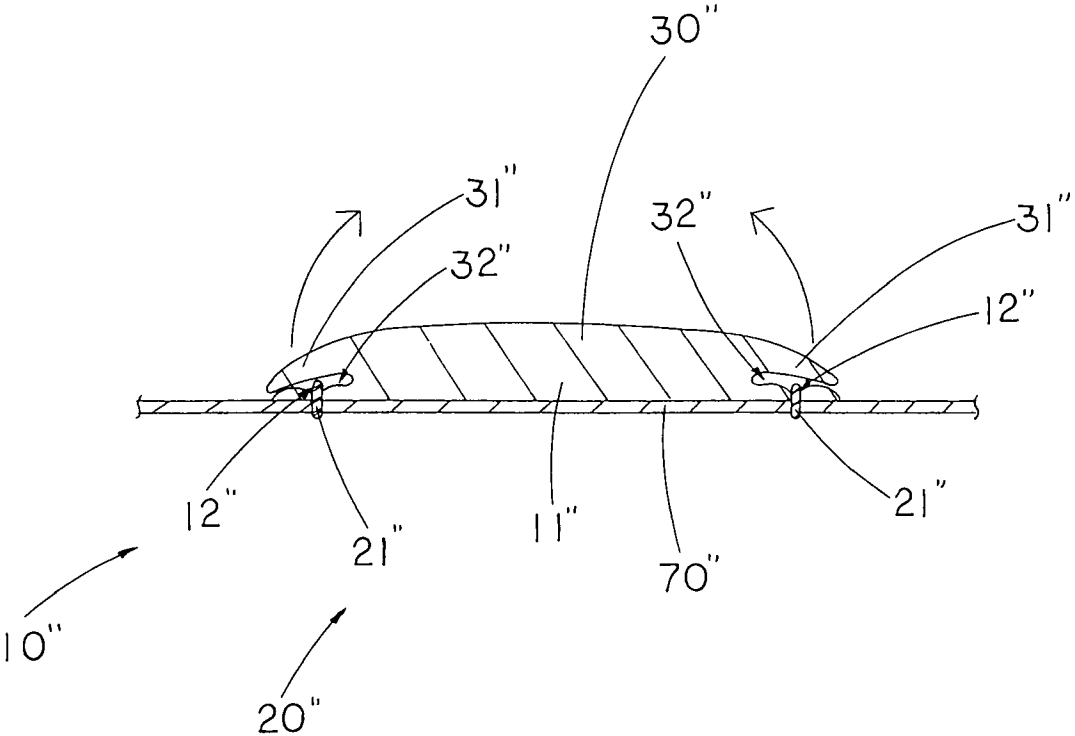
FIG. 4 is a second alternative mode of the logo patch arrangement according to the above first preferred embodiment of the present invention.

Referring to FIG. 4 of the drawings, a second alternative mode of the logo patch arrangement according to the preferred embodiment of the present invention is illustrated. According to the second alternative mode, the background patch 10" has a patch body 11" and two guiding grooves 12" indently formed and extended along two side edge portions of the patch body 11", wherein the affixing element 20" is adapted to repeatedly and reciprocally penetrate the garment 70" and the patch body 11" so as to form a plurality of stitching lines 12" received within the guiding grooves 12" for overlappedly and securely sewing the garment 70" with the background patch 10".

Moreover, according to the second alternative mode of the present invention, the logo patch 30" is integrally extended from the background patch 10" and further comprises two elastic enclosing members 31" integrally and spacedly extended on the background patch 10" to form two elongated sideline channels 32" within the two enclosing members 31" and the background patch 10" to receive an exposing portion of the affixing element 20" in the sideline channels 32", wherein the enclosing members 31" normally cover on the patch body 11" to enclose the sideline channels 32" respectively so as to hidden the affixing element 20" therewithin.

In other words, the two enclosing members 31" are extended on the background patch 10" to move between a normal enclosing position and an open position, wherein in the enclosing position, the enclosing members 31" are movably extend on the background patch 10" to substantially enclose the sideline channels 32" respectively so as to hide the affixing elements 20" under the curtain of the respective enclosing members 31", wherein in the opened position, the enclosing members 31" are upwardly stretched to expose the respective sideline channels 32" to an exterior of the logo patch arrangement so as to allow user to access the sideline channels 32" for sewing the background patch 10" with the garment 70". According to the second alternative mode, the enclosing members 31" are elastic in nature in such a manner that they are normally retained at the enclosing position. As shown in FIG. 4, the guiding grooves 12" are formed along the patch body 11" and are aligned with the sideline channels 32".

In other words, as in the first alternative mode, by stretching the enclosing members 31" to the opened position, the manufacturer of the cloth is able to easily sew the background patch 10" to the garment 70" by the affixing element 20" and once that is finished, the enclosing members 31" would automatically return to the enclosing position so as to display the aesthetic pattern of the logo patch 30" without exposing the affixing element 20".

Figure 5:
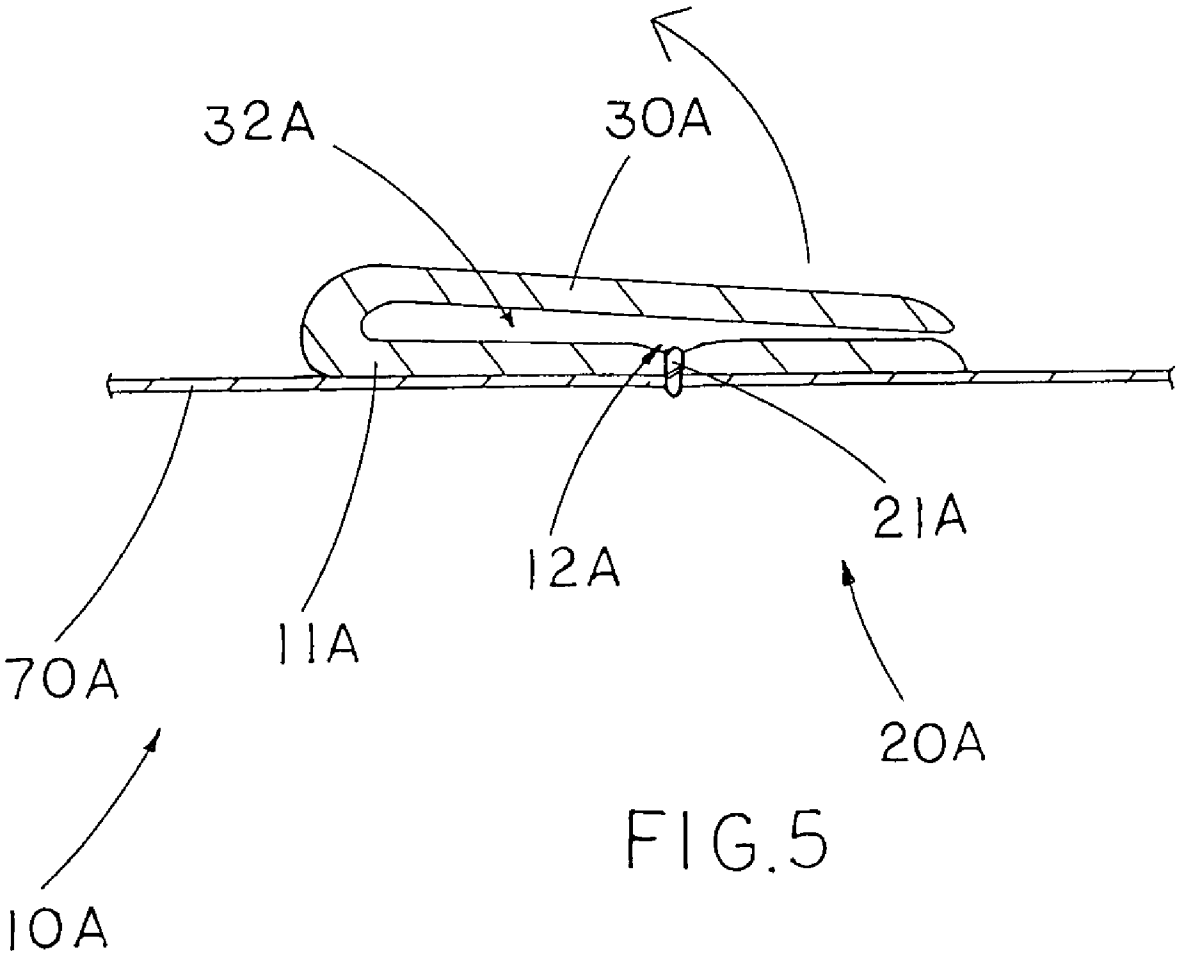
FIG. 5 is a third alternative mode of the logo patch arrangement according to the above first preferred embodiment of the present invention.

Referring to FIG. 5 of the drawings, a third alternative mode of the logo patch arrangement according to the above preferred embodiment of the present invention illustrated, wherein the logo patch 31A is integrally formed on the background 10A as a one-piece body.

According to the third alternative mode, the logo patch 30A is integrally extended from the background patch 10A in an edge to edge manner to form a U-shaped cross sectional structure and define an elongated channel 32A between the logo patch 30A and the background patch 10A to receive an exposing portion of the affixing element 20A in the elongated channel 32A, wherein the logo patch 30A normally covers on the background patch 10A to enclose the elongated channel 32A so as to hidden the affixing element 20A therewithin.

In other words, the logo patch 30A is integrally and extended from a side edge portion of the background patch 10A in a foldably moveable manner so as to normally enclose the elongated channel 32A so as to cover the affixing element 20A underneath the logo patch 30A. It is worth to mention that the logo patch 30A, which is made by elastic materials, is capable of unfolding for allowing the user to access the elongated channel 32A for sewing the background patch 10A with the garment 70A.

As shown in FIG. 5, the background patch 10A has a guiding groove 12A indently formed on a top surface of the patch body 11A to receive an exposing portion of the affixing element 20A in the guiding groove 12A and to guide the affixing element 20A for affixing the patch body 11A on the garment 70A. Accordingly, the guiding groove 12A is formed along the patch body 11A and is aligned with the elongated channel 32A.

The affixing element 20A comprises a plurality of stitching lines 21A spacedly forming on the background patch 10A for securely affixing the background patch 10A on the garment 70A. Alternatively, the affixing element 20A can be a plastic-made rivet 20' for joining the background patch 10A with the garment 70A.

Figure 6:
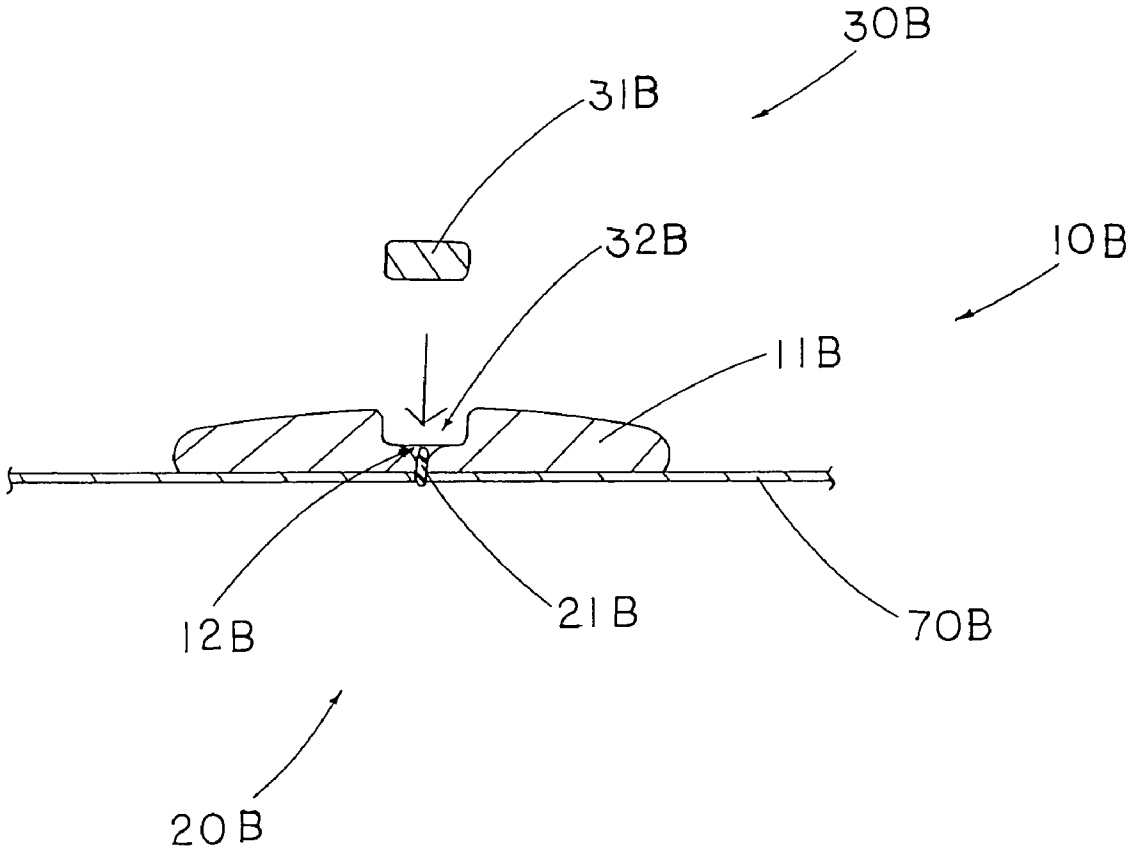
FIG. 6 is a sectional view of a logo patch arrangement according to a second preferred embodiment of the present invention.

As shown in FIG. 6, a logo patch arrangement of a second embodiment illustrates an alternative mode of the first embodiment, wherein the logo patch arrangement comprises a background patch 10B made of non-fabric material, an affixing element 20B substantially affixing the background patch 10B on the garment 70B, and a logo patch 30B overlapped on the background patch 10B to cover the affixing element 20B for enhancing an aesthetic appearance of the logo patch arrangement while the logo patch 30B is securely affixed on the garment 70B via the background patch 10B.

Accordingly, the background patch 10B has a patch body 11B shaped and sized to form a predetermined pattern corresponding to the logo patch 30B which is to be shown on the garment 70B, and a guiding groove 12B indently formed on a top surface of the patch body 11B.

The affixing element 20B comprises a plurality of stitching lines 21B spacedly forming on the background patch 10B for securely affixing the background patch 10B on the garment 70B. In other words, the affixing element 20B is adapted to repeatedly and reciprocally penetrate the garment 70B and a bottom surface of the patch body 11B so as to form a plurality of stitches received within the guiding groove 12B for overlappedly and securely sewing the garment 70B with the background patch 10B.

The logo patch 30B has an elongated channel 32B formed on the background patch 10B to receive an exposing portion of the affixing element 20B in the elongated channel 32B and an enclosing member 31B fitted into the elongated channel 32B to enclose the elongated channel 32B so as to hidden the affixing element 20B therewithin.

Accordingly, the elongated channel 32B is substantially formed along a centerline of the background patch 10B to align with the guiding groove 12B. The logo patch 32B can be glued on the background patch 10B along the elongated channel 32B to cover the affixing element 20B. Alternatively, the logo patch 32B can be filled into the elongated channel 32B to hidden the affixing element 20B.

From the forgoing descriptions, it can be shown that the above-mentioned objects have been substantially achieved. The present invention provides a logo patch arrangement wherein an affixing element is kept under the curtain of a logo patch without exposing to an exterior thereof so as to enhance an aesthetic appeal thereof while securely attaching the logo patch on the garment.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A logo patch arrangement for a piece of garment, comprising:

a background patch made of non-fabric material;

an affixing element substantially affixing said background patch on said garment; and a logo patch overlapped on said affixing element to cover said affixing element, wherein said affixing element is hidden by said logo patch for enhancing an aesthetic appeal thereof while said logo patch is securely affixed on said garment via said background patch, wherein said background patch has a patch body shaped and sized corresponding to said logo patch and a guiding groove indently formed on a top surface of said patch body to receive an exposing portion of said affixing element in said guiding groove and to guide said affixing element for affixing said patch body on said garment.

2. The logo patch arrangement, as recited in claim 1, wherein said affixing element comprises a plurality of stitching lines spacedly forming on said background patch for securely affixing said background patch on said garment.

3. The logo patch arrangement, as recited in claim 1, further comprising an adhering agent applied on said background patch to adhere said logo patch on said background patch so as to integrally attach said logo patch on said background patch.

4. The logo patch arrangement, as recited in claim 2, further comprising an adhering agent applied on said background patch to adhere said logo patch on said background patch so as to integrally attach said logo patch on said background patch.

5. The logo patch arrangement, as recited in claim 1, wherein said logo patch comprises two elastic enclosing members integrally and spacedly extended on said background patch to form an elongated centerline channel within said two enclosing members and said background patch to receive an exposing portion of said affixing element in said centerline channel, wherein said enclosing members are normally extended to meet each other to enclose said centerline channel so as to hidden said affixing element therewithin.

6. The logo patch arrangement, as recited in claim 5, wherein said guiding groove is formed along said patch body and is aligned with said centerline channel.

7. The logo patch arrangement, as recited in claim 6, wherein said affixing element comprises a plurality of stitching lines spacedly forming on said background patch for securely affixing said background patch on said garment.

8. The logo patch arrangement, as recited in claim 6, wherein said affixing element is embodied as a plastic-made rivet for joining said background patch with said garment.

9. The logo patch arrangement, as recited in claim 1, wherein said logo patch comprises two elastic enclosing members integrally and spacedly extended on said background patch to form two elongated sideline channels within said two enclosing members and said background patch to receive an exposing portion of said affixing element in said sideline channels, wherein said enclosing members normally cover on said patch body to enclose said sideline channels respectively so as to hidden said affixing element therewithin.

10. The logo patch arrangement, as recited in claim 9, wherein said guiding groove is formed along said patch body and is aligned with each of said sideline channels.

11. The logo patch arrangement, as recited in claim 10, wherein said affixing element comprises a plurality of stitching lines spacedly forming on said background patch for securely affixing said background patch on said garment.

12. The logo patch arrangement, as recited in claim 1, wherein said logo patch is integrally extended from said background patch in an edge to edge manner to form a U-shaped cross sectional structure and define an elongated channel between said logo patch and said background patch to receive an exposing portion of said affixing element in said elongated channel, wherein said logo patch normally covers on said background patch to enclose said elongated channel so as to hidden said affixing element therewithin.

13. The logo patch arrangement, as recited in claim 12, wherein said guiding groove is formed along said patch body and is aligned with said elongated channel.

14. The logo patch arrangement, as recited in claim 13, wherein said affixing element comprises a plurality of stitching lines spacedly forming on said background patch for securely affixing said background patch on said garment.

15. A logo patch arrangement for a piece of garment, comprising:

a background patch made of non-fabric material;

an affixing element substantially affixing said background patch on said garment; and a logo patch overlapped on said affixing element to cover said affixing element, wherein said affixing element is hidden by said logo patch for enhancing an aesthetic appeal thereof while said logo patch is securely affixed on said garment via said background patch, wherein said logo patch comprises two elastic enclosing members integrally and spacedly extended on said background patch to form an elongated centerline channel within said two enclosing members and said background patch to receive an exposing portion of said affixing element in said centerline channel, wherein said enclosing members are normally extended to meet each other to enclose said centerline channel so as to hidden said affixing element therewithin.

16. The logo patch arrangement, as recited in claim 15, wherein said affixing element comprises a plurality of stitching lines spacedly forming on said background patch for securely affixing said background patch on said garment.

17. The logo patch arrangement, as recited in claim 15, wherein said affixing element is embodied as a plastic-made rivet for joining said background patch with said garment.

* * * * *